US006320576B1

(12) United States Patent
Kim

(10) Patent No.: US 6,320,576 B1
(45) Date of Patent: Nov. 20, 2001

(54) METHOD AND APPARATUS FOR CONTROLLING MONITOR USING VIDEO SIGNAL

(75) Inventor: Yong-Hee Kim, Suwon-si (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/084,587

(22) Filed: May 27, 1998

(30) Foreign Application Priority Data

May 27, 1997 (KR) ..... 97-20944

(51) Int. Cl.[7] ..... G09G 5/00

(52) U.S. Cl. ..... 345/214; 345/213; 345/157; 345/667

(58) Field of Search ..... 345/88, 204, 213, 345/214, 10, 11, 163, 904, 157, 667, 156, 162, 160, 161, 167–168, 173; 382/169

(56) References Cited

U.S. PATENT DOCUMENTS 4,788,586 * 11/1988 Eckenbrecht ..... 358/28
5,539,540 * 7/1996 Spaulding et al. ..... 358/518
5,544,284 * 8/1996 Allebach et al. ..... 395/131
5,565,897 * 10/1996 Kikinis et al. ..... 345/213
5,629,780 * 5/1997 Watson ..... 358/432
5,822,453 * 10/1998 Lee et al. ..... 382/169
5,852,431 * 12/1998 Ito ..... 345/145
6,078,361 * 6/2000 Reddy ..... 348/558

* cited by examiner

*Primary Examiner*—Bipin Shalwala
*Assistant Examiner*—Mansour M. Said
(74) *Attorney, Agent, or Firm*—Robert E. Bushnell, Esq.

(57) ABSTRACT

In a method and arrangement for controlling a monitor, a video signal is transmitted from a computer to the monitor and is sampled to digitize it and obtain a corresponding signal. Control of the monitor is achieved according to the corresponding signal. A computer program is executed to select a function for controlling the monitor, and a control signal is output through a video card of the computer. Then, color signals transmitted from the computer are sampled to analyze a control function and carry it out. Accordingly, the monitor can be controlled using software, even in a system which does not use a separate cable or does not employ a USB device. The number of control keys set on the monitor can be reduced, and a user is permitted to control various functions. The product cost of the monitor is decreased, and design of the front of the monitor is simplified.

25 Claims, 8 Drawing Sheets

METHOD AND APPARATUS FOR CONTROLLING MONITOR USING VIDEO SIGNAL

CLAIM OF PRIORITY

This application makes reference to, incorporates the same herein, and claims all benefits accruing under 35 U.S.C. §119 from my applications entitled METHOD OF CONTROLLING MONITOR USING VIDEO SIGNAL filed in the Korean Industrial Property Office on the May 27, 1997 and there duly assigned Ser. No. P97-20944 by that Office.

BACKGROUND OF THE INVENTION

1. Technical Field

The present invention relates to a method and arrangement for controlling a display device, and more specifically, to a method of controlling a display device by sampling a video signal (R,G,B) applied by a computer to the display device so as to digitize it, and controlling the display device according to a corresponding signal.

2. Related Art

A monitor is a typical peripheral device for a computer, and is one of the display devices which displays a signal sent from a computer as an image so as to allow a user to recognize it. For satisfactory operation of a monitor, proper synchronous signals and color signals are required. Such signals are typically generated by a video card in a computer with which the monitor is associated, and are transmitted to the monitor. The color signals are typically provided by amplification circuitry to the cathode ray tube (CRT) forming the display device, while the synchronous signals are typically provided to a microcomputer provided in the monitor.

The user is normally provided with the capability of controlling various monitor functions by the use of control knobs located on a portion (usually the front portion) of the monitor. Such knobs are used for controlling the functions of brightness, contrast, and so forth. The greater the number of functions to be controlled, the greater the number of control knobs or keys required on the monitor. If a large number of functions are required, but a limited or small number of keys are provided (sometimes, with an on-screen display), the control knobs or keys have to be pushed several times and an on-screen display (OSD) is separately needed. This produces difficulties and inconvenience in the control of the monitor.

The above problem can be solved to some extent by the employment of a recently developed device, known as a USB device. The USB has the main advantage of simplicity and convenience, and automatically determines information about system resources required for each peripheral device, securing this information to allow the display to use it without interference from the user. However, control of a monitor using the USB can be carried out only in a system employing the USB mode.

Therefore, there is a need for the development of a method of controlling a monitor in which a minimum number of key or control knobs are set on the monitor. Moreover, it will be preferable to develop a monitor which is controlled through a video signal line using computer software without employing an additional communication line.

SUMMARY OF THE INVENTION

An object of the present invention is to provide a method and arrangement for controlling a monitor, in which the minimum number of keys are set on the monitor, and the monitor is controlled through a video signal line using computer software without employing an additional communication line.

To accomplish the object of the present invention, there is provided a method of controlling a monitor, including the steps of counting horizontal and vertical frequencies, setting a sampling point depending on the count result, storing data as to color signals (R,G,B) at the sampling point in a temporary storage, confirming a color signal which informs of initiation of input of a signal for controlling the monitor, and confirming the control signal.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Figure 1:
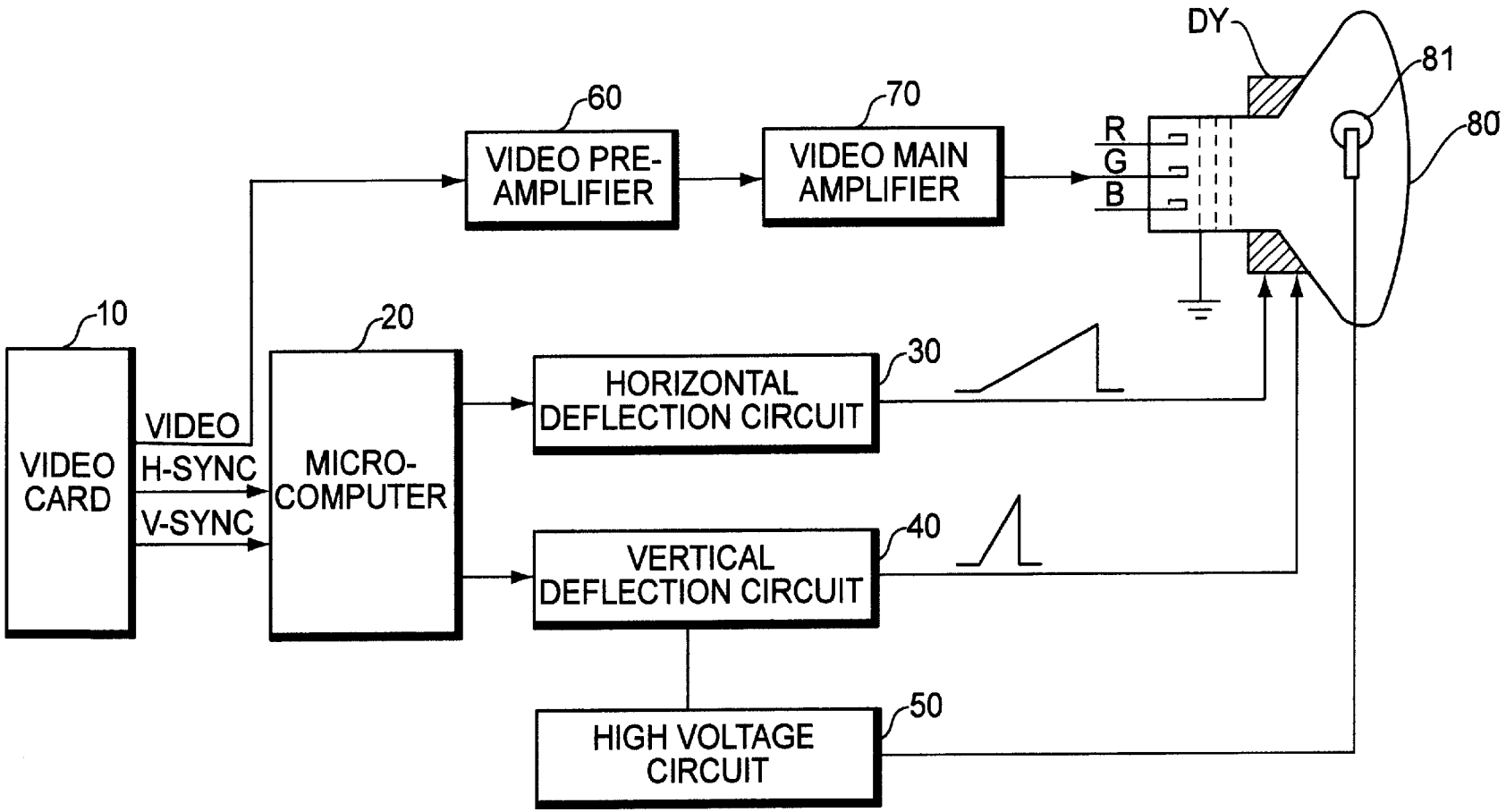
FIG. 1 is a block diagram showing the inner configuration of a display device.

FIG. 1 is a block diagram of the inner circuitry of a display device. Referring to FIG. 1, the inner circuit includes: a video card 10 in a computer (not shown) for providing color signals (R,G,B), and horizontal and vertical synchronous signals H-Sync/V-Sync, which are required for forming an image; a microcomputer 20 for receiving the horizontal and vertical synchronous signals from video card 10 and generating a picture control signal for controlling the monitor picture; horizontal and vertical deflection circuits 30 and 40, respectively, for receiving the horizontal and vertical synchronous signals, respectively, and performing horizontal and vertical deflections to enable electron beam generated from an electron gun of a CRT 80 to be sequentially deflected starting from the top of the left portion of CRT 80 to the bottom of its right portion by a defection yoke, thereby forming an image; a high voltage circuit 50 for supplying a high voltage to the anode 81 of CRT 80 using a blanking pulse generated from the output port of horizontal deflection circuit 40 according to the principles of a switching circuit and a high voltage technique; a video pre-amplifier 60 for amplifying a low-level video signal (R,G,B) transmitted from video card 10 with a low voltage amplification to maintain a specific voltage level; and a video main amplifier 70 for amplifying the signal amplified by video pre-amplifier 60 to 40Vpp to 60Vpp of signal, thereby supplying energy to each pixel of the display.

This display device forms an image using the electron beam projected onto its fluorescent screen. A circuit for deflecting the electron beam is called a deflection circuit. The deflection mode is generally divided into electrostatic deflection using an electric field and electromagnetic deflection using a magnetic field. Electromagnetic deflection is used, for example, in a TV in which a sawtooth current flows through horizontal and vertical coils to form a picture.

For satisfactory operation of the monitor, proper synchronous signals and color signals are required. Microcomputer 20 receives a video signal from the computer (not shown) through its input port. This video signal is transmitted in the form of a composition of color signals (R,G,B) and synchronous signals H-SYNC and V-SYNC, or in the form of separate color and synchronous signals. The video signal is gain-controlled or amplified through video pre-amplifier 60 and video main amplifier 70. According to the principle of an electron gun, rays of light are emitted from only the center of cathode ray tube (CRT) 80. Thus, the electron beam must deflect in order to radiate the rays of light onto the entire face of the CRT 80 uniformly. This is called deflection of the electron beam. Horizontal and vertical deflection yokes DY control the deflection of the electron beam depending on the intensity of the current applied thereto, allowing the electron beam to reach every corner of the CRT 80.

Scanning is an operation wherein the electron beam deflects from the top of the left portion of the CRT 80 to the bottom of its right portion. The scanning cycle of deflection in a reception-side CRT is determined depending on the cycle of sawtooth current of the deflection yoke DY, and it must correspond to a scanning cycle that a transmission side wants. The accordance of the scanning cycles of the transmission side and the reception side is called synchronization. Horizontal synchronous signal H-SYNC is applied to horizontal deflection circuit 30, and vertical synchronous signal V-SYNC is applied to vertical deflection circuit 40.

Figure 2:
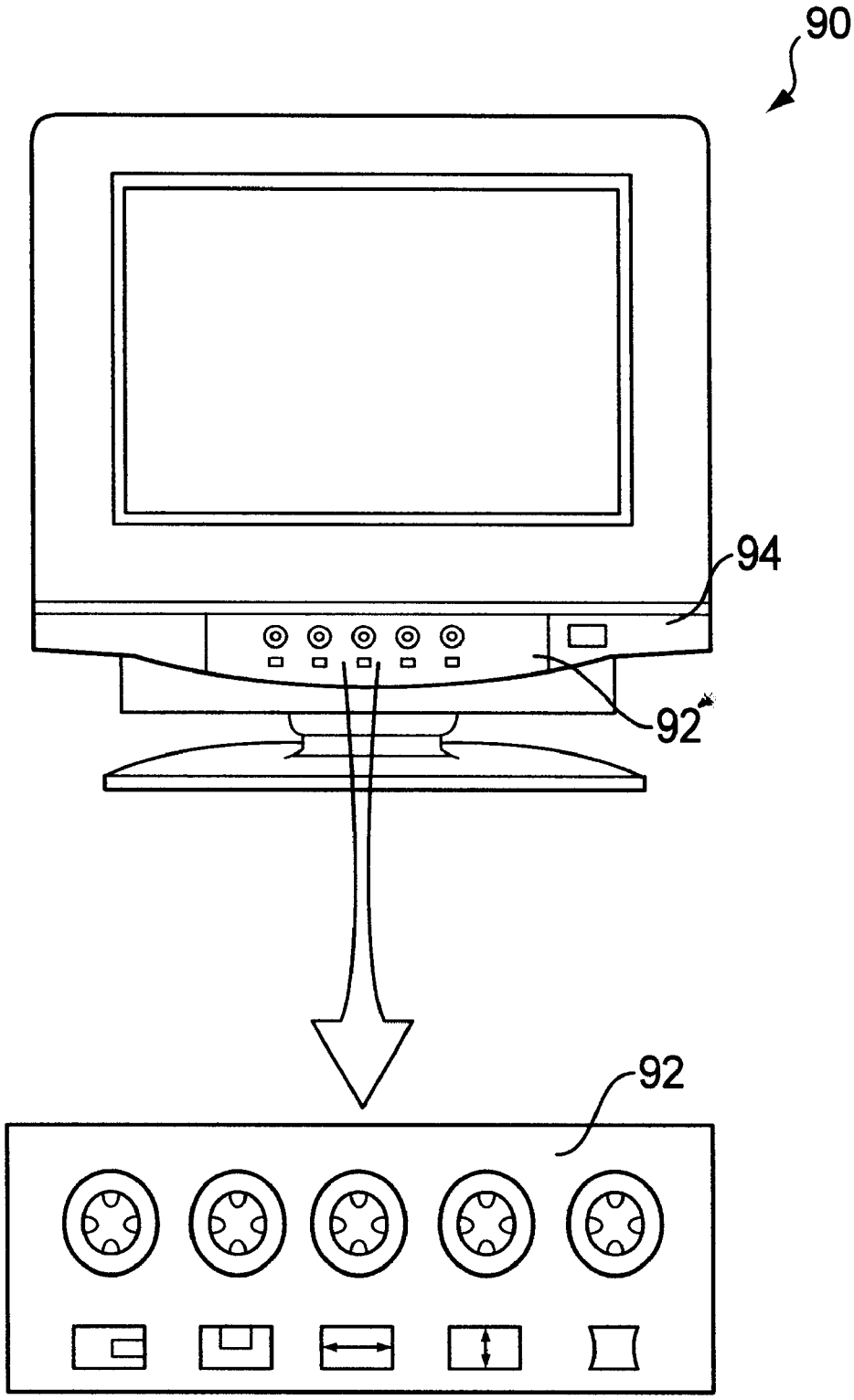
FIG. 2 is a diagram showing various control keys set on the front of a monitor.

As seen in FIG. 2, to control functions of a monitor 90, monitor 90 includes a plurality of control knobs 92 set at the lower portion of its front 94. These knobs 92 are used for controlling the functions of brightness, contrast, side pincushion, and horizontal/vertical size and position. For controlling all functions of the monitor 90 with the above configuration, a number of keys are required on the monitor 90. If a small number of keys and an on-screen display (OSD) are used in the monitor 90, the keys have to be pushed several times and an OSD-IC is separately needed, thereby producing difficulties in the control of the monitor 90.

In addition, a modem, printer, sound device and scanner are used as computer peripheral devices. Each of these devices must occupy a port obtained from one of slots usable on the motherboard in the computer. For this, a user is required to open the computer's case and insert interface cards into slots and into the board. Furthermore, there are cases where the user has to operate switches, set jumpers, and divide connectors into parallel and serial types. Due to these complicated procedures, users easily give up on the setting of new devices. Moreover, there are limits as to the number in slots of the computer, and thus the addition of peripheral devices is not possible when all slots are occupied.

Figure 3:
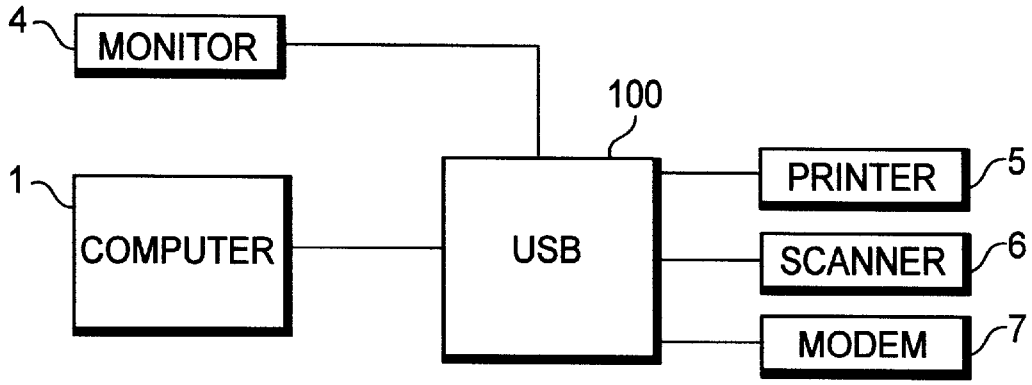
FIG. 3 is a block diagram of a computer system employing a USB device.

To meet the demand for more various convenient peripheral devices, a computer system using USB, as shown in FIG. 3, has been developed. FIG. 3 shows USB 100, computer 1, monitor 4, printer 5, scanner 6 and external modem 7. With the use of USB 100, the addition of peripheral device becomes very easy, so that there is no need for the user to open the computer case to connect peripheral devices or related cards. Devices like keyboard and display are directly connected to the computer and other peripheral devices are easily connected through extension hubs included in the keyboard and display, or through a separate USB device. These extension hubs provide additional connection sockets and can be connected in a tree configuration. The peripheral devices may have up to several meters of distance from one another or from the extension hub.

The USB 100 has two main advantages: simplicity and convenience. The USB 100 detects the addition or removal of a device to/from the computer based on information from the computer. This operation can be performed in a power-on state, in contrast to the operation of conventional built-in slots. Thus, there is no need to reboot the system. Moreover, the USB 100 supports real plug-and-play operation. The USB 100 automatically determines information about resources, such as driver software and bus bandwidth, required for each peripheral device, and secures the information to allow the display to use it without interference from the user. However, controlling of a monitor using the USB can be carried out only in a system employing the USB mode.

A method and arrangement for controlling a monitor using a video signal according to the present invention will now be explained with reference to FIGS. 4A–4B and 5–8 of the attached drawings.

A computer executes a program for controlling a monitor using a video signal. When a specific key on a keyboard is pushed or a mouse is clicked in a specific area of the monitor after the execution of the program, the computer sends a predetermined signal, synchronizing the signal with the horizontal and vertical synchronous signals. The predetermined signal is transmitted with the lapse of a period of time (t+a) starting from the nth horizontal synchronous signal which follows the vertical synchronous signal. When a period of time to store horizontal signal information in an address is sufficient, high and low levels of the R,G,B color signal are sent, corresponding to the predetermined signal, in a cycle (t+a) in one horizontal synchronous signal.

Figure 4A:
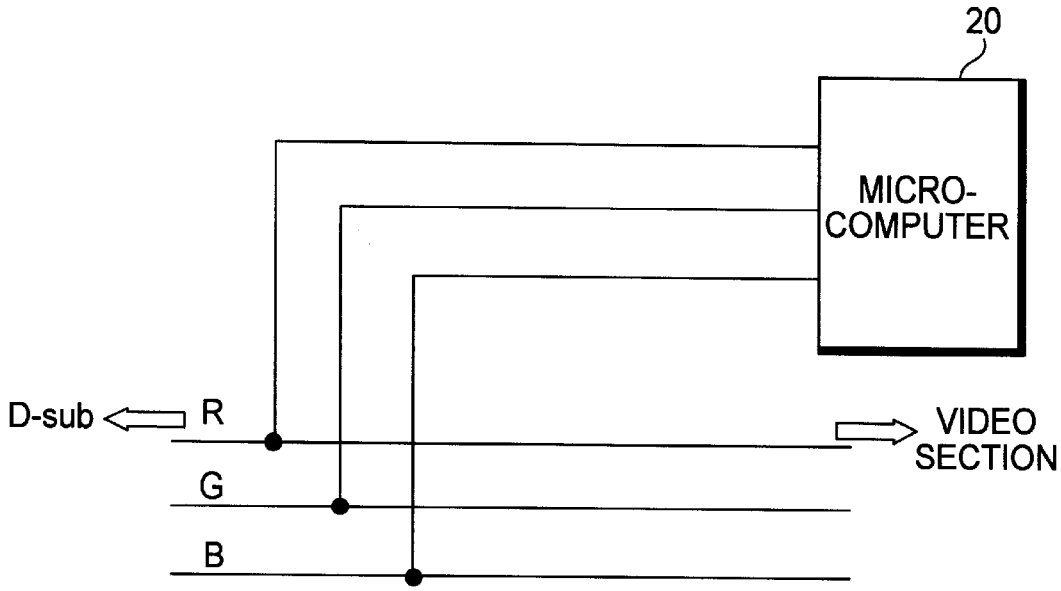
FIGS. 4A and 4B are diagrams showing methods of connecting signal lines according to the present invention.
Figure 4B:
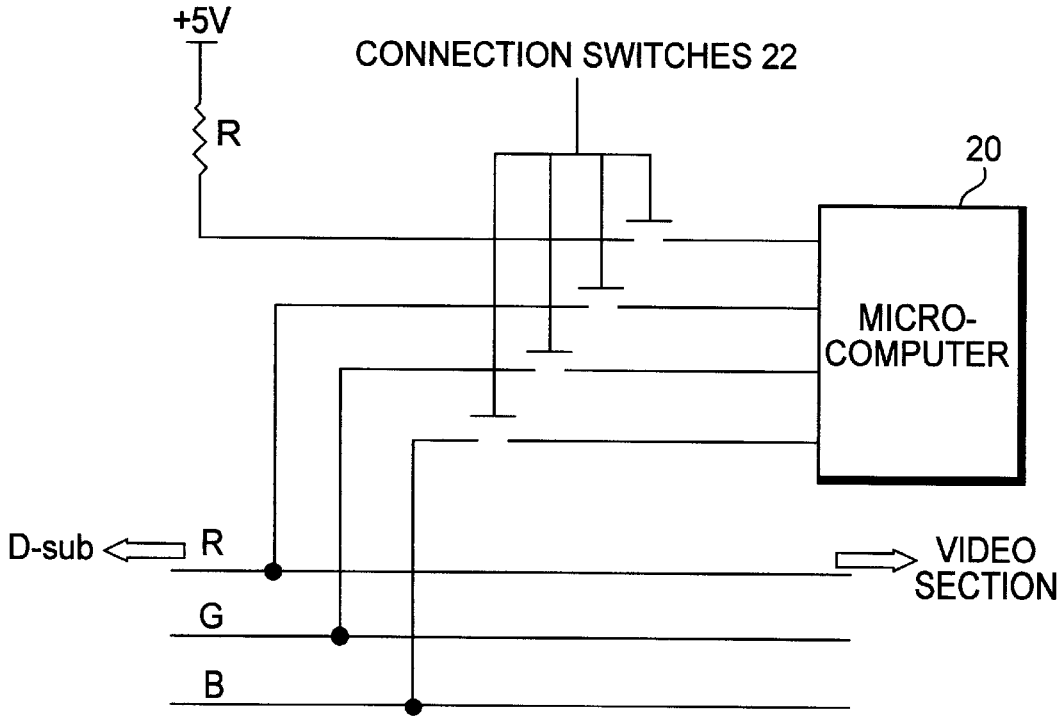

FIG. 4A illustrates connection of signal lines according to an embodiment of the present invention. This shows that the color signals (R,G,B) generated by the video card 10 of the computer (now shown) are input to the microcomputer 20 continuously. FIG. 4B illustrates connection of signal lines according to another embodiment of the present invention, in which the color signal is input to the microcomputer 20 only when connection switches 22 are closed. When the color signals (R,G,B) are directly connected to the microcomputer 20, as shown in FIG. 4A, the color signals are periodically checked. In the case of FIG. 4B, a check pin is checked to check the level of the color signals only when they are transmitted to the microcomputer 20.

To check the level of R,G,B color signals, first of all, it is required to determine a point where the levels of signals will be checked. The microcomputer 20 checks the synchronous signals H-SYNC and V-SYNC all the time. Sampling points are set after the lapse of time (t) from the input of the nth horizontal synchronous signal which follows the vertical synchronous signal. The number of sampling points is previously set to as many as a predetermined number. When the number of sampling points is m, the level of each of the R,G,B signals is sampled using registers as many as mX3, and is stored.

Figure 5:
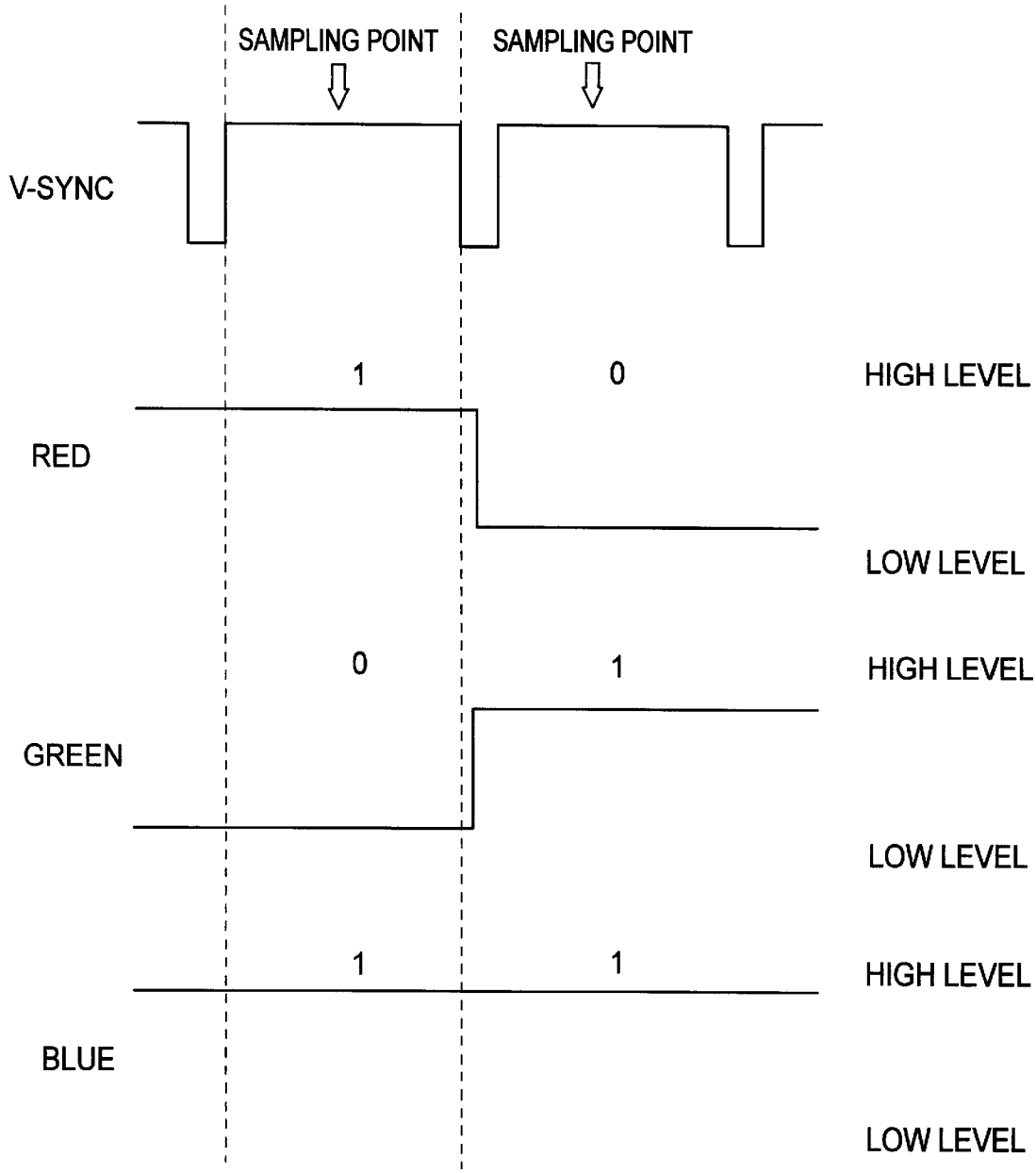
FIG. 5 is a diagram showing signals having three sampling times during one horizontal synchronous signal, as transmitted between the computer and the monitor's microcomputer.
Figure 6:
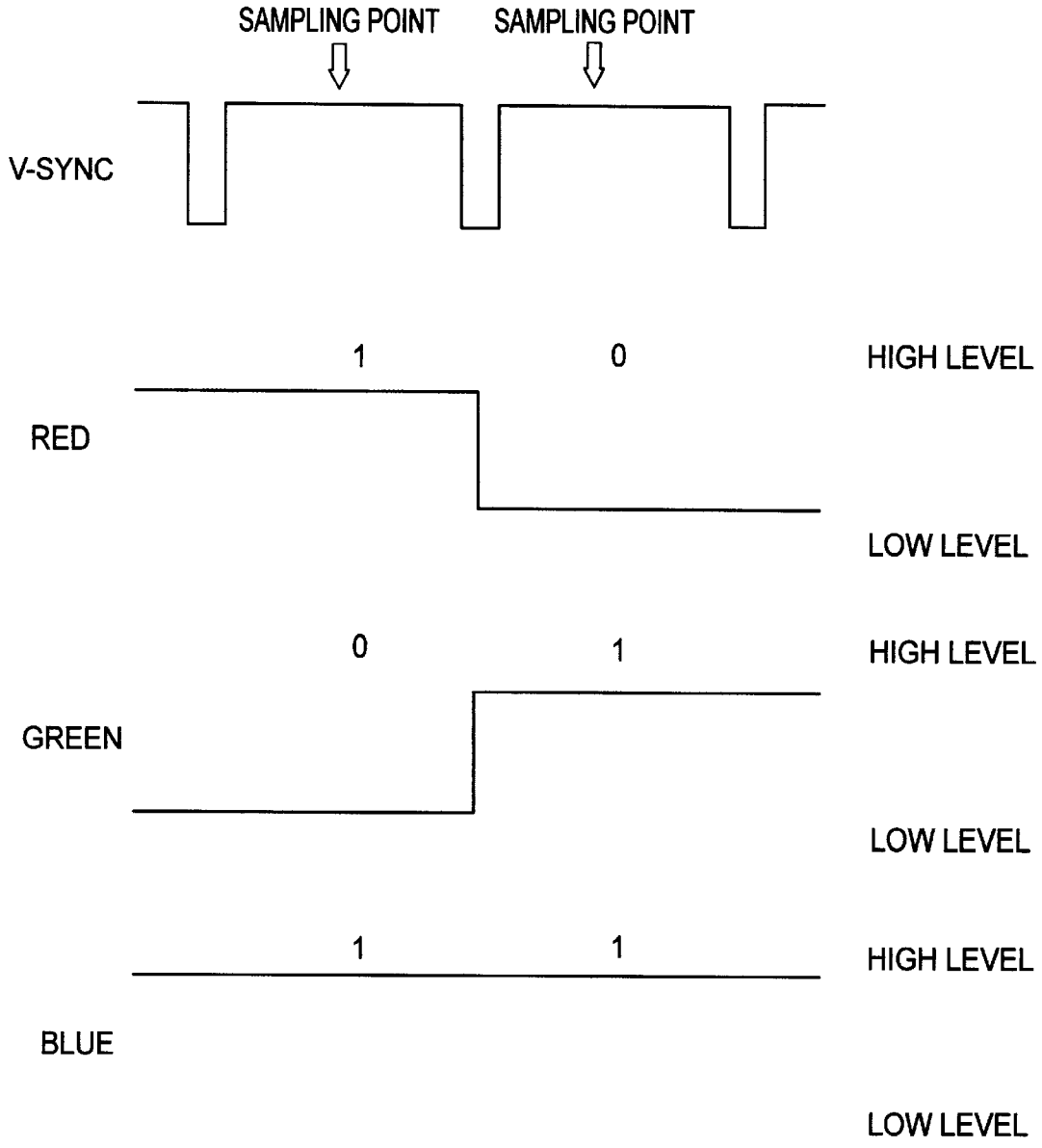
FIG. 6 is a diagram showing signals having sampling times different from those of FIG. 5.

FIG. 5 shows that the R,G,B signals have three time intervals during one horizontal synchronous signal. Each of the R,G,B signals is checked at the sampling points, and then its level is coded. The code for the R signal is 1,0,0, the code for the G signal is 1,1,0, and the code for the B signal is 0,1,0. When each code value corresponds to a predetermined code, the microcomputer 20 performs a corresponding function, and informs the user of execution of the function through recognition means, such as a light emitting diode (LED). When it is difficult to set the sampling times during the period of a horizontal synchronous signal, the sampling times may be set on the basis of one period of the vertical synchronous signal, as shown in FIG. 6.

When the user selects a specific function using the keyboard or mouse, the computer maintains the R,G,B color signals in a low level or high level by one period of the vertical synchronous signal to form specific codes. Then, the computer uses the codes as signals to inform of the start of communication between the computer and monitor. The monitor, after input of the vertical synchronous signal, checks the level of each of the R,G,B signals during N vertical synchronous signal. When the level corresponds to a predetermined code, the monitor recognizes the next R,G,B signals as functions, codes them, and performs corresponding functions. FIG. 6 shows an example in which the code for R signal is 1,0, the code for the G signal is 0,1, and the code for the B signal is 1,1 during two vertical cycles.

Figure 7:
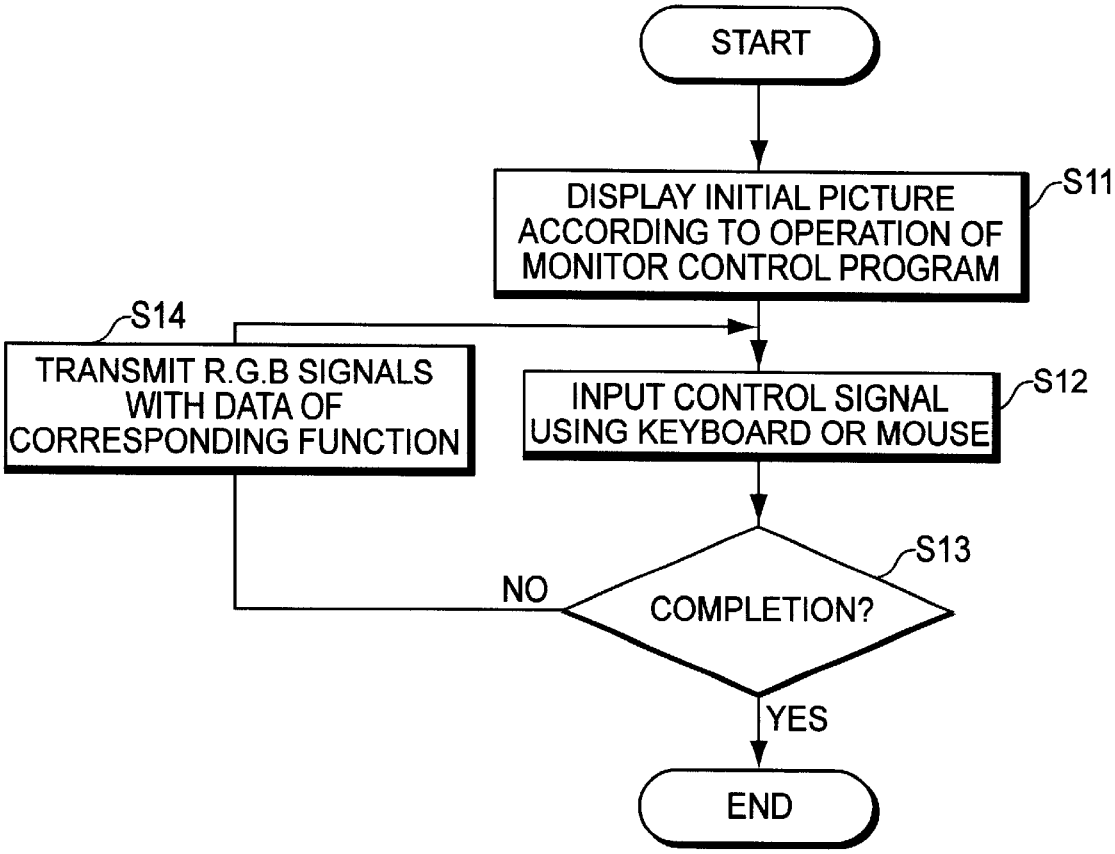
FIG. 7 is a flow diagram showing a method of controlling a monitor using a video signal according to the present invention.
Figure 8:
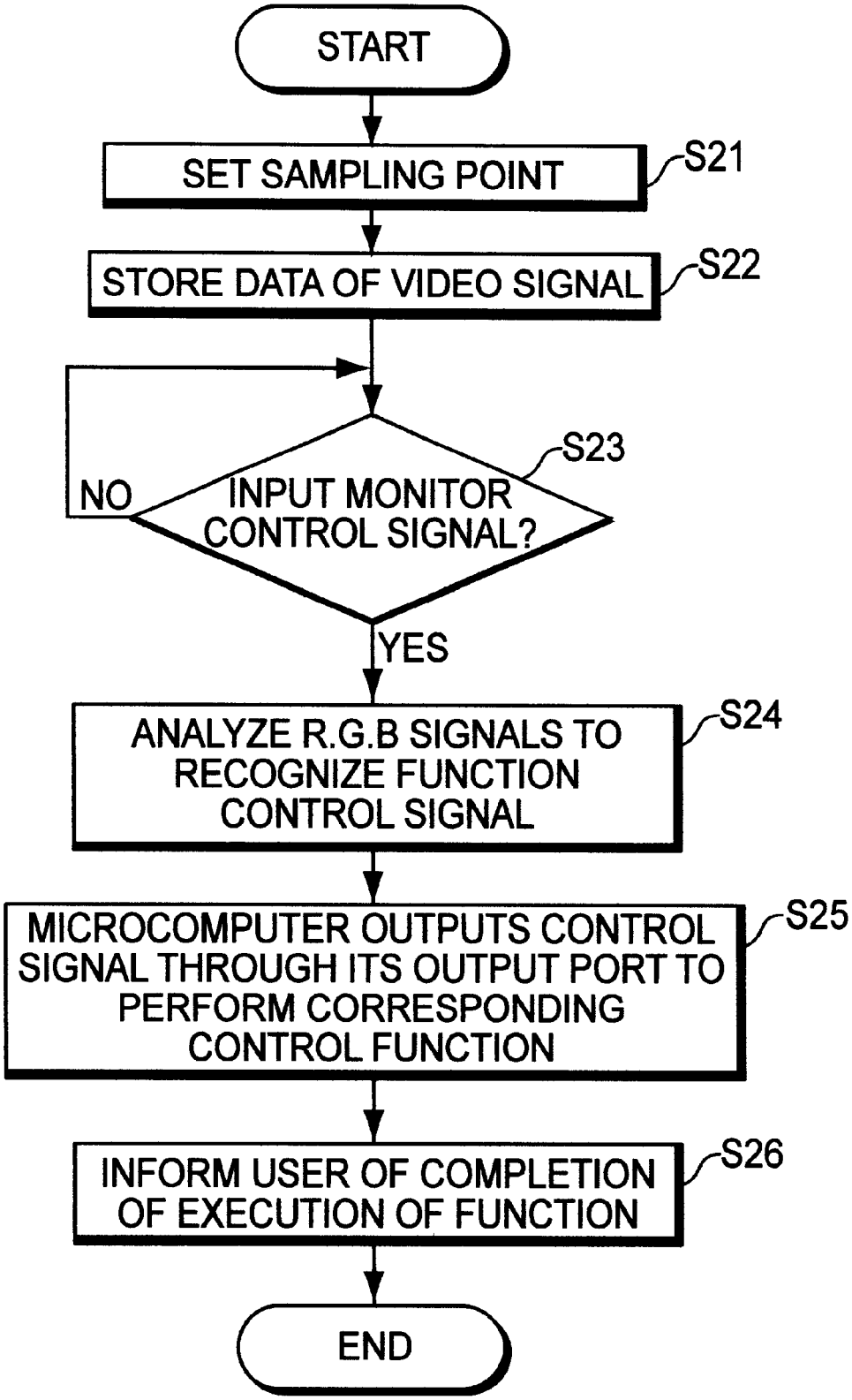
FIG. 8 is a flow diagram showing signal processing between the monitor and computer.

FIGS. 7 and 8 are flow diagrams showing processes for controlling a monitor using a video signal according to the present invention. FIG. 7 shows a process of combining the R,G,B color signals to form specific commands. In step S11, the initial picture with normal R,G,B signals is sent to the monitor to be displayed thereon. At this time, with the computer, a specific key on the keyboard is pushed or the mouse is clicked in a specific region of the monitor to drive a program. In step S12, the user inputs a control signal using the keyboard or mouse for selecting a function. Here, variations to be controlled are listed in the following table.

| | |
|---|---|
| H-position | V-focus |
| H-size | H-convergence |
| V-position | Red-cutoff |
| V-size | Green-cutoff |
| Side pincushion | Blue-cutoff |
| Trapezoid | Red-gain |
| Parallelogram | Green-gain |
| Pin-balance | Blue-gain |
| Tilt | Contrast |
| V-linearity | Brightness |
| H-focus | |

In step S13, it is determined whether the key input in step S12 means the start of a program or completion of the program. When the key input does not mean the completion of the program, color signals having data with corresponding function are transmitted to the monitor through a D-sub cable in step S14. At this time, the microcomputer of the monitor operates as shown in FIG. 8 to perform the corresponding function according to the color signals received through the cable. First of all, the microcomputer counts the horizontal and vertical synchronous signals to set sampling points for analyzing the R,G,B color signals (step S21). That is, after the vertical synchronous signal is input, and a predetermined Nth horizontal synchronous signal is subsequently input, microcomputer 20 sets the sampling points at intervals corresponding to period T. The sampling points are reset whenever the frequency changes.

The microcomputer 20 stores data as to each of the R,G,B signals at every sampling point in a buffer (step S22). Here, the data is stored as a binary value of "0" or "1" according to the levels of color signals at each sampling point. Then, in response to input of a monitor control signal (step S23), the microcomputer 20 analyzes the data of each color signal stored in the buffer, and waits for the input of R,G,B signals for initializing the control of function of the monitor. When the user selects a variation value, the computer outputs R,G,B signals for controlling a function according to corresponding variation value with the program (S24). These R,G,B signals are applied to the microcomputer 20 as code values, and the microcomputer 20 outputs a control signal for performing a function according to a corresponding code value through its output port (S25). Here, The magnitude of control value may be transmitted using a specific pin of the D-sub cable. After the completion of execution of the function, the microcomputer informs the user of the completion of the function using an LED (S26).

As described above, the present invention controls the monitor using software, even in a system which does not use a separate cable such as an RS232C, or does not employ the USB device. Furthermore, the present invention can reduce the number of control keys set on the monitor, and allow the user to control various functions. Moreover, it is possible to decrease the product cost for the monitor and to simplify the design of the front of the monitor.

It will be apparent to those skilled in the art that various modifications and variations can be made in the method of controlling a monitor using a video signal of the present invention without departing from the spirit or scope of the invention. Thus, it is intended that the present invention cover the modifications and variations of this invention provided they come within the scope of the appended claims and their equivalents.

What is claimed is:

1. A method of controlling a monitor using a video signal, wherein a computer transmits the video signal and controls various parameters for adjusting the picture of the monitor and the monitor has a microcomputer, the method comprising the steps of:

selecting a monitor function to be controlled using one of a keyboard and a mouse;

converting a level of the video signal into a code value to indicate the selected monitor function;

receiving, the video signal transmitted from the computer with the microcomputer in the monitor; and analyzing the video signal so as to determine, from the level of the video signal, the code value indicating the selected monitor function and to identify and control the selected monitor function:

wherein the analyzing step comprises recognizing levels of R,G,B color signals as signals on the basis of a specific point after a horizontal synchronous signal arid a vertical synchronous signal.

2. A method of controlling a monitor using a video signal, wherein a computer transmits the video signal and controls various parameters for adjusting the picture of the monitor and the monitor has a microcomputer, the method comprising the steps of:

selecting a function to be controlled;

converting a level of the video signal into a code value to indicate the selected function;

receiving the video signal transmitted from the computer with the microcomputer in the monitor; and analyzing the video signal so as to determine and to control the selected function;

said method further comprising the steps of storing software for controlling the monitor in the computer, and executing the software according to selection by a user;

wherein the selecting step comprises selecting a monitor control function that the user wants using one of a keyboard and a mouse; and wherein the method further comprises transmitting R,G,B color signals corresponding to the control function so as to transmit the selected control function to the monitor.

3. The method as claimed in claim 2, wherein the analyzing step comprises recognizing levels of the R,G,B color signals as signals on the basis of a specific point after a horizontal synchronous signal.

4. The method as claimed in claim 2, wherein the analyzing step comprises recognizing levels of the R,G,B color signals as signals on the basis of a specific point after a vertical synchronous signal.

5. A method of controlling a monitor using a video signal, wherein a computer transmits the video signal and controls various parameters for adjusting the picture of the monitor and the monitor has a microcomputer, the method comprising the steps of:

selecting a function to be controlled;

converting a level of the video signal into a code value to indicate the selected function;

receiving the video signal transmitted from the computer with the microcomputer in the monitor; and analyzing the video signal so as to determine and to control the selected function;

wherein the analyzing step comprises the steps of:

setting sampling points within a predetermined period of time in one cycle of a horizontal synchronous signal where R,G,B color signals can be checked;

digitizing levels of the R,G,B color signals at each of said sampling points to obtain data;

analyzing the data to identify and perform a corresponding monitor control function; and informing a user of completion of execution of the control function.

6. The method as claimed in claim 5, wherein the sampling points are set at predetermined intervals of time after input of a horizontal synchronous signal after a vertical synchronous signal.

7. The method as claimed in claim 5, further comprising the step of temporarily storing the data obtained in the digitizing step prior to analyzing the data in the analyzing step.

8. A method of controlling a monitor using a video signal transmitted by a computer to a monitor, the method comprising the steps of:

providing the monitor with a microcomputer and a monitor control program stored therein;

entering an input control signal by use of one of a keyboard and a mouse to designate a monitor function to be performed;

transmitting color signals, including data identifying the monitor function to be performed, to the monitor;

analyzing the video signals, including the data identifying the monitor function to be performed, so as to determine the monitor function to be performed; and executing the monitor function to be performed;

wherein the analyzing step comprises setting sample points in one cycle of a horizontal synchronous signal where R,G,B color signals can be checked.

9. The method as claimed in claim 8, wherein said analyzing step comprises recognizing levels of the R,G,B color signals as a code value indicating the monitor function to be performed.

10. The method as claimed in claim 9, wherein the levels of the R,G,B color signals are recognized as signals at a specific point after a vertical synchronous signal.

11. The method as claimed in claim 9, wherein the levels of the R,G,B color signals are recognized as signals at a specific point after a horizontal synchronous signal.

12. The method as claimed in claim 8, wherein said analyzing step further comprises digitizing levels of the R,G,B color signals at each of said sampling points to obtain data.

13. The method as claimed in claim 12, wherein said analyzing step further comprises analyzing the data to identify and perform the designated monitor function.

14. The method as claimed in claim 13, wherein the sampling points are set at predetermined intervals of time after input of a horizontal synchronous signal.

15. The method as claimed in claim 12, wherein said analyzing step further comprises the step of temporarily storing the data obtained in the digitizing step prior to analysis.

16. The method as claimed in claim 8, further comprising connecting lines for carrying said color signals directly to said microcomputer, whereby said microcomputer continuously receives said color signals.

17. A method of controlling a monitor using a video signal transmitted by a computer to a monitor, the method comprising the steps of:

providing the monitor with a microcomputer and a monitor control program stored therein;

entering an input control signal by use of one of a keyboard and a mouse to designate a monitor function to be performed;

transmitting color signals, including data identifying the monitor function to be performed, to the monitor;

analyzing the video signals, including the data identifying the monitor function to be performed, so as to determine the monitor function to be performed; and executing the monitor function to be performed;

said method further comprising providing lines for carrying said color signals, providing connection switches, and connecting said lines for carrying said color signals via said connection switches to said microcomputer, whereby said microcomputer only receives said color signals when said connection switches are closed.

18. The method as claimed in claim 17, wherein said analyzing step comprises recognizing levels of the R,G,B color signals as a code value indicating the monitor function to be performed.

19. The method as claimed in claim 18, wherein the levels of the R,G,B color signals are recognized as signals at a specific point after a vertical synchronous signal.

20. The method as claimed in claim 18, wherein the levels of the R,G,B color signals are recognized as signals at a specific point after a horizontal synchronous signal.

21. An arrangement for controlling a monitor using a video signal, wherein a computer transmits the video signal and controls various parameters for adjusting the picture of the monitor, comprising:

microcomputer means disposed in said monitor for controlling functions of said monitor;

selecting means for selecting a function of the monitor to be controlled; and input means connected between said computer and said microcomputer means for transmitting the video signal, including data indicating the selected function to be controlled, to said microcomputer means;

wherein said microcomputer means analyzes the video signal by setting sampling points in one evcle of a horizontal synchronous signal where R,G,B color signals can be checked so as to determine and to control the selected function.

22. The arrangement as claimed in claim 21, further comprising connection switch means connected to said input means and having a closed position for permitting said video signal to be input to said microcomputer means, and having an open position for blocking said video signal from being input to said microcomputer means.

23. The arrangement as claimed in claim 21, wherein said selecting means comprises one of a keyboard and a mouse.

24. The arrangement as claimed in claim 21, wherein said video signal comprises color signals, and wherein said microcomputer means digitizes levels of the color signals at each of a plurality of sampling points to obtain data.

25. The arrangement as claimed in claim 24, wherein said microcomputer means analyzes the data obtained from said digitizing step to identify and perform the selected monitor control function.

* * * * *